US005976750A

United States Patent [19]

Hagi et al.

[11] Patent Number: 5,976,750

[45] Date of Patent: Nov. 2, 1999

[54] ELECTROSTATIC LATENT IMAGE-DEVELOPING TONER CONTAINING SPECIFIED TONER PARTICLES AND SPECIFIED EXTERNAL ADDITIVES

[75] Inventors: Masayuki Hagi, Takatsuki; Junichi Tamaoki, Sakai; Takeshi Arai, Akashi; Hiroyuki Fukuda, Kobe, all of Japan

[73] Assignee: Minolta Co., Ltd., Osaka, Japan

[21] Appl. No.: 09/014,001

[22] Filed: Jan. 27, 1998

[30] Foreign Application Priority Data

Jan. 28, 1997 [JP] Japan ..... 9-013577
Jan. 28, 1997 [JP] Japan ..... 9-013578

[51] Int. Cl.[6] ..... G03G 9/08
[52] U.S. Cl. ..... 430/110; 430/111
[58] Field of Search ..... 430/110, 111

[56] References Cited

U.S. PATENT DOCUMENTS

| | | | |
|---|---|---|---|
| 4,623,605 | 11/1986 | Kato et al. . | |
| 4,626,487 | 12/1986 | Mitsuhashi et al. . | |
| 4,987,454 | 1/1991 | Natsuhara et al. . | |
| 5,120,631 | 6/1992 | Kanbayashi et al. . | |
| 5,137,796 | 8/1992 | Takiguchi et al. . | |
| 5,272,040 | 12/1993 | Nakasawa et al. . | |
| 5,504,559 | 4/1996 | Ojima et al. . | |
| 5,612,159 | 3/1997 | Sato et al. | 430/110 |
| 5,659,857 | 8/1997 | Yamazaki et al. | 430/110 |
| 5,774,768 | 6/1998 | Hazama et al. | 399/170 |

OTHER PUBLICATIONS

Diamond, Arthur S. (editor). Handbook of Imaging Materials. New York:Marcel–Dekker, Inc. p. 178. 1991.

*Primary Examiner*—Christopher D. Rodee

*Attorney, Agent, or Firm*—McDermott, Will & Emery

[57] ABSTRACT

The present invention provides an electrostatic latent developing toner which comprises:

toner particles containing a colorant and a binder resin, the toner particles satisfying the following relation:

$$1.45-0.05\,D_{50} \leqq D_{25}/D_{75} \leqq 1.75-0.05D_{50} \quad (1)$$

(in which $D_{25}$, $D_{50}$ and $D_{75}$ denote toner particle sizes such that when the toner particles are integrated from the larger particle side, the volume percentages of toner particles of respective particle sizes are 25%, 50%, and 75% based on the total volume of the toner particles), particle size $D_{50}$ being within the range of from 3 to 7 $\mu$m; or the toner particles having a volume-mean particle size of 3 to 7 $\mu$m and a shape factor SF1 of 100 to 130 as expressed by the following relation (2):

$$SF1=\{100\,\pi\times(\text{max length})^2\}/\{4\times(\text{area})\} \quad (2)$$

(in which, "max length" represents mean value of maximum lengths of projected toner particle images, and "area" represents mean value of projected toner particle areas); and an external additive admixed with the toner particles, the external additive containing hydrophobic inorganic fine particles A having a number-mean particle size of 5 to 70 nm, and inorganic fine particles B having a number-mean particle size of 80 to 800 nm with a 20 number % or less content of particles having a particle size of 1000 nm or more.

16 Claims, No Drawings

ELECTROSTATIC LATENT IMAGE-DEVELOPING TONER CONTAINING SPECIFIED TONER PARTICLES AND SPECIFIED EXTERNAL ADDITIVES

RELATED APPLICATIONS

This application is based on Japanese Patent Application No. 9-13577 and 9-13578, each of content of which being incorporated by reference.

BACKGROUND OF THE INVENTION

1. Field of the Invention

The present invention relates to a toner for developing an electrosatic latent image formed on an electrostatic latent image-supporting member.

2. Description of the Prior Art

An image forming method which includes the steps of developing an electrostatic latent image formed on an electrostatic latent image-supporting member, such as potosensitive member, by using a toner, and transferring the resulting toner image onto a recording medium, such as recording paper, has been widely employed in copying machines, printers, facsimile, and also in full-color image forming apparatus which reproduces a multicolor image by superposing a plurality of color toners one over another.

Such an electrostatic latent image-developing toner to be used in various types of image forming apparatuses is required to have different characteristics according to the types of such apparatus. In image forming apparatuses of a digital system, for example, a variable area gradation system or a laser intensity modulation system is adopted as a variable contrast image reproduction system. Whichever system of the two may be employed, however, for good image tone reproduction, the toner is required to have high fluidity. Especially where the laser intensity modulation system is employed, higher fluidity is required of the toner so as to enable tone reproduction to conform to any toner deposit variation corresponding to a change in the charge quantity of the latent image due to laser intensity modulation. Further, for use in a full-color image forming apparatus, wherein toners of different colors are subjected to multiple transfer for full-color image reproduction, the toner must have good transfer characteristics.

Since full color toners are such that color reproduction is carried out by a mixture of different color toners, for such color reproduction it is necessary that the full color toner must have good light transmission characteristics. Therefore, the binder resin used in the toner particles must possess sharp melt characteristics. Unfortunately, however, a toner having such characteristics is apt to cause toner aggregation due to a stress or the like imposed upon the toner in the developing apparatus during voluminous printing. This poses the possibility of void occurrence in a solid image that is attributable to the toner aggregation.

Further, full color toners are required to achieve higher grade halftone reproduction and finer particle feature than in the case of monochrome toners, and this necessitates particle size reduction with respect to full color toners. However, particle size reduction may tend to cause the toner to be adversely affected by heat and/or stress, resulting in toner particle agglomeration, and also in fluidity and cleanability degradation.

In order to meet the foregoing characteristic requirements, therefore, various problems exist to be overcome from technical standpoints. Conceivably, for example, one effective approach for fluidity improvement is to externally add a fluidizing agent, such as fine silica particulate or fine titania particulate, to the toner, thereby to increase the quantity of addition of such an agent. However, increased addition of external additives tends to result in an increase in the quantity of the external agent added to the toner which may pass through the cleaning blade and adhere to the surface of the potosensitive member. This in turn poses a problem such that the external agent which has adhered to the potosensitive member surface acts as a nucleus to which other toner components may adhere in a trailing fashion during the process of cleaning. As a result, the problem of external agent retention on the potosensitive member surface (hereinafter referred to as "BS") is pronounced. If the quantity of the external additive is reduced with a view to preventing the occurrence of BS, the fluidity of the toner becomes insufficient; in addition, toner aggregation may occur due to a stress or the like exerted on the toner in the developing apparatus during voluminous printing, and this may lead to the problem of voids in a solid image. A toner of reduced particle size naturally has an increased fine powder content, so that aforementioned problem is more pronounced with respect to the toner. If a spherical toner of reduced particle size is used for improvement of image quality and transfer performance, toner particles passing through the cleaning blade will increase in number, thus causing unsatisfactory cleaning which will in turn lead to image noise generation.

SUMMARY OF THE INVENTION

It is a primary object of the present invention to provide an electrostatic latent image-developing toner which solves the foregoing problems.

It is another object of the invention to provide an electrostatic latent image-developing toner which has good fluidity and solves the problem of toner component adhesion to the electrostatic latent image supporting member.

It is another object of the invention to provide an electrostatic latent image-developing toner which solves the problem of fine toner-particle aggregation.

It is a further object of the invention to provide an electrostatic latent image-developing toner which is suitable for the purpose of full-color image forming.

It is a still further object of the invention to provide an electrostatic latent image-developing toner which has good fluidity and solves the poor cleanability problem with respect to fine-sized spherical toner particles and the problem of toner component adhesion to the electrostatic latent image supporting member.

According to a first aspect of the invention, there is provided an electrostatic latent image-developing toner which comprises:

toner particles containing a colorant and a binder resin, the toner particles satisfying the following relation:

$$1.45-0.05D_{50} \leqq D_{25}/D_{75} \leqq 1.75-0.05D_{50} \quad (1)$$

(in which $D_{25}$, $D_{50}$ and $D_{75}$ denote toner particle sizes such that when the toner particles are integrated from the larger particle side, the volume percentages of toner particles of respective particle sizes are 25%, 50%, and 75% based on the total volume of the toner particles), particle size $D_{50}$ being within the range of from 3 to 7 $\mu$m; and an external additive admixed with the toner particles, the external additive containing hydrophobic inorganic fine particles A having a number-mean particle size of 5 to 70 nm, and inorganic fine particles B having a number-mean particle size of 80 to 800 nm with a 20 number % or less content of particles having a particle size of 1000 nm or more.

According to a second aspect of the invention, there is provided an electrostatic latent image-developing toner which comprises:

toner particles containing a colorant and a binder resin, the toner particles having a volume-mean particle size of 3 to 7 μm and a shape factor SF1 of 100 to 130 as expressed by the following relation (2):

$$SF1=\{100\pi\times(\text{max length})^2\}/\{4\times(\text{area})\} \quad (2)$$

(in which, "max length" represents mean value of maximum lengths of projected toner particle images, and "area" represents mean value of projected toner particle areas); and an external additive admixed with the toner particles, the external additive containing hydrophobic inorganic fine particles A having a number-mean particle size of 5 to 70 nm, and inorganic fine particles B having a number-mean particle size of 80 to 800 nm with a 20 number % or less content of particles having a particle size of 1000 nm or more.

DETAILED DESCRIPTION OF THE PREFERRED EMBODIMENTS

The electrostatic latent image-developing toner according to the first aspect of the invention is based on the discovery that the above mentioned problems can be solved by using a specific external additive in admixture with specific toner particles which have been subjected to particle size reduction by pulverization.

In the toner of the first aspect of the invention, toner particles used (hereinafter referred to as first toner particles) are such that they satisfy the above shown relation (1), with $D_{50}$ being within the range of 3 to 7 μm. If $D_{50}$ is smaller than 3 μm, the direct yield achievable in the process of preparing toner particles by pulverization and classification is low, and this results in higher cost of production and degradation of handling characteristics (e.g., toner-scattering or toner-dusting) in the image forming apparatus. If $D_{50}$ is larger than 7 μm, it is difficult to attain good improvement in tone reproduction and surface texture. In the relation (1), if $D_{25}/D_{75}$ is larger than $1.75-0.05D_{50}$, the charge distribution of toner particles becomes broader, which leads to the problem of toner dusting. If $D_{25}/D_{75}$ is smaller than $1.45-0.05D_{50}$, the particle size distribution of toner particles becomes narrower, so that direct yield in the process of pulverization and classification for toner preparation is lowered, resulting in lower production efficiency and higher cost of production. This is particularly noticeable in the case where toner particles are prepared by the pulverization technique. In the pulverization technique, if a toner of smaller particle size is intended to be prepared, greater crushing energy is required. Therefore, the toner has an increased fine powder content resulting from excessive crushing. If such fine powder content is removed by fine powder classification until $D_{25}/D_{75}$ becomes smaller than $1.45-0.05\ D_{50}$, the production efficiency is considerably lowered. From the foregoing viewpoints, in the present invention it is desirable that $D_{50}$ be within the range of 4 to 7 μm and that $D_{25}/D_{75}$ be within the range of $1.50-0.05\ D_{50}$ to $1.70-0.05\ D_{50}$. It is noted that the above mentioned $D_{25}$, $D_{50}$, and $D_{75}$ are measured by using Coulter counter multisizer II (manufactured by COULTER K.K.).

The toner according to the second aspect of the present invention is based on the discovery that above mentioned problems can be solved by using a specific external additive in admixture with specific toner particles of spherical shape which have been made smaller in particle size.

In the toner of the second aspect, toner particles used (hereinafter referred to as second toner particles) are within a volume-mean particle size range of 3 to 7 μm and have a shape factor SF1 of 100 to 130 as expressed by the earlier shown relation (2). If the volume-mean particle size is larger than 7 μm, no sufficient effect for tone reproduction and texture improvement could be obtained in full-color images. If the volume-mean particle size is smaller than 3 μm, there may occur handling inconveniences, such as dusting, in the image forming apparatus. If SF1 is larger than 130, the effect of the toner for transfer improvement is reduced and, at the same time, the fluidity of the toner is lowered, when the particle size of the toner is reduced. Preferred toner particles are within a volume-mean particle size range of from 4 to 7 μm, and within an SF1 range of from 103 to 125, more preferably from 105 to 120.

Above mentioned shape factor SF1 values are values obtained from 100 scanning electrode microscopic toner particle photos which are randomly sampled from those enlarged by a 1000×magnification, the image information of the photos being input to an image analyzer ("Luzex III", manufactured by Nireco K.K.) for analysis, the SF1 values being determined in accordance with the earlier shown relation (2). The above mentioned volume-mean particle size value ranges were measured by using Coulter counter multisizer II (manufactured by COULTER K.K.).

The above described first toner particles are of smaller particle sizes and have a somewhat broad particle size distribution. Therefore, the fluidity and aggregation characteristic of the toner particles are relatively low. The second toner particles are also of a smaller-particle size range but have a spherical configuration. By virtue of such configuration the second toner particles have improved fluidity. However, the fluidity is still insufficient to permit the second toner to be used as a full color toner and, in addition, the aggregation property of the second toner particles has been degraded as a result of the particle size reduction.

In the present invention, therefore, inorganic fine particles A of hydrophobic properties having a number-mean particle size (mean primary particle size) of 5 to 70 nm, preferably 5 to 60 nm, are used as an external additive. For the inorganic fine particles A, silica, titania, alumina, and the like may be used singly or in combination. The quantity of addition of inorganic fine particles A to the toner particles is 0.8 to 3.0% by weight, preferably 1.0 to 2.5% by weight, more preferably 1.2 to 2.0% by weight. If the quantity of such addition is less than 0.8% by weight, no sufficient improvement in fluidity and agglomeration characteristic could be obtained with respect to the first toner particles, nor with respect to the second toner particles. As a result, there may occur grain degradation in halftone images and/or the problem of voids in images due to toner aggregation. If the quantity of such addition is more than 3.0% by weight, BS is likely to occur and, in order to prevent such occurrence, an increased addition of inorganic fine particles B to be hereinafter described is required, which results in a cost increase.

Preferred inorganic fine particles A are within a number-mean particle size range of 5 to 40 nm, preferably 5 to 35 nm, more preferably 5 to 30 nm, and have a hydrophobicity of 50 or more. From the standpoint of effective improvement of fluidity, in the case where one kind of fine-particle material is used as inorganic fine particles A, it is necessary that the fine-particle material must be within a number-mean particle size range of 5 to 40 nm. Likewise, in the case where two or more kinds of fine-particle materials are used in combination as such, it is desirable that the fine particles be within a number-mean particle size range of 5 to 40 nm.

Hydrophobicizing agents usable for surface-treating inorganic fine particles A include silane coupling agents, titanate coupling agents, silicone oil, and silicone varnish. Silane coupling agents usable as such include, for example, hexamethyl disilazane, trimethyl silane, trimethyl chlorosilane, dimethyl dichlorosilane, methyl trichlorosilane, allyldimethyl chlorosilane, benzyldimethyl chlorosilane, methyl trimethoxysilane, methyl triethoxysilane, isobutyl trimethoxysilane, dimethyl dimethoxysilane, dimethyl diethoxysilane, trimethyl methoxysilane, hydroxypropyl trimethoxysilane, phenyl trimethoxysilane, n-butyl trimethoxysilane, n-hexanedecyl trimethoxysilane, n-octadecyl trimethoxysilane, vinyl trimethoxysilane, vinyl triethoxysilane, γ-methacryloxypropyl trimethoxysilane, and vinyl triacetoxysilane. Examples of useful silicone oils are dimethyl polysiloxane, methyl hydrogen polysiloxane, and methyl phenyl polysiloxane.

While a toner comprising aforesaid first or second toner particles and inorganic fine particles A externally added thereto has improved fluidity and cohesiveness, the presence of 0.8% by weight or more of inorganic fine particles A may possibly be a cause of a BS problem. Further, aforesaid second toner particles are of a reduced particle size and spherical in shape, and this poses the problem of cleaning inconvenience. In order to solve these problems, according to the present invention, the toner particles are externally loaded with inorganic fine particles B having a number-mean particle size of 80 to 800 nm, preferably 100 to 700 nm, more preferably 150 to 600 nm, with a 20 number % or less content, preferably 15 number % or less content, more preferably 10 number % or less content, of particles having a particle size of 1000 nm or more. More preferably, the inorganic fine particles B include 20 number % or less, preferably 15 number % or less content, more preferably 10 number % or less, of particles having a particle size of 800 nm or more. By using such inorganic fine particles B it is possible to solve various problems, such as BS, arising from the addition of inorganic fine particles A, without any damage, such as flaws, being caused to the potosensitive member. Further, the use of inorganic fine particles B eliminates the problem of cleaning inconvenience which may arise in the case where second toner particles are used which are of reduced particle size and spherical in shape. Conceivably, the reason for this may be that the inorganic fine particles B have good properties which function to prevent other fine particles from passing through the cleaning section (an contact portion of the cleaning blade with the electrostatic image supporting member).

If the number-mean particle size of inorganic fine particles B is smaller than 80 nm, the BS preventing effect of the inorganic fine particles B is insufficient, and their capability of cleaning effect enhancement is also insufficient. If the number-mean particle size is larger than 800 nm, they may tend to separate from the toner particle surfaces, it being thus difficult to keep them in adhesion to toner particle surfaces. Further, such larger size particles tend to cause flaws to the potosensitive member. If the content of particles having a particle size of 1000 nm or more is more than 20 number %, free inorganic fine particles B tend to increase in number such that they are present in liberated state in the toner without being held in adhesion to toner particle surface, so that the earlier mentioned effect of inorganic fine particles B is lowered. If the number-mean particle size is larger than 800 nm, or if the content of particles having a particle size of 1000 nm or more is more than 20 number %, the toner is unfavorably affected in respect of light transmittance capability when the toner is used as a light-transmittable color toner. Further, such inorganic fine particles B are apt to damage the potosensitive member during a blade cleaning operation when image formation is repeated, or during a press transfer operation using a transfer drum in a full color image forming apparatus or the like.

For the inorganic fine particles B, fine particles including, for example, silica, titania, alumina, barium titanate, magnesium titanate, calcium titanate, strontium titanate, chromium oxide, cerium oxide, magnesium oxide, and zirconium oxide may be used each alone or in combination of two or more. Preferred inorganic fine particles are rutile-type titania or strontium titanate. Especially preferred is a strontium titanate containing sintered aggregate particles having above mentioned number-mean particle size range. The sintered aggregate particles are primary particle sintered aggregates having a grape cluster-like configuration.

Inorganic fine particles B are added to the toner particles in the proportion of 0.3 to 5.0% by weight, preferably 0.5 to 3.0% by weight. If the quantity of addition is less than 0.3% by weight, no sufficient effect could be obtained for purposes of preventing BS and fogging. If the quantity of addition is more than 5% by weight, such addition may lead to a cost increase, though no particular effect is exerted in any characteristic respect. Where the addition is excessive, the light transmittance of the toner may possibly be adversely affected, if the toner is a color toner.

The inorganic fine particles B may have been surface-treated with aforesaid agent, such as hydrophobic agent, amino coupling agent, or amino-silicone oil.

External addition of aforesaid inorganic fine particles A and B to the toner particles may be carried out by mixing them together by means of a mixing apparatus, such as Henschel mixer.

The method of producing the first toner particles is not particularly limited because such toner particles can be produced by a conventional method for toner particle production known as such. However, for production of the toner in accordance with the first aspect of the present invention, toner particles prepared by a kneading and crushing method are preferably used from the standpoints of toner particle production yield and cost saving. Such first toner particles may contain any desired additives, such as charge control agent and wax, in addition to binder resin and colorants.

For the binder resin used in the first toner particles, any resins known as such may be used including, for example, styrene resins, acrylic resins such as alkyl alkylate and alkyl methacrylate, styrene-acrylic copolymer resins, polyester resins, epoxy resins, silicon resins, olefin resins, and amide resins. These resins may be used each alone or in combination of two or more. Especially preferred as binder resins are polyester resins.

In the present invention, binder resins for use in full color toners, such as cyan toner, magenta toner, yellow toner, and black toner, are preferably those having a number-mean molecular weight (Mn) of 3000 to 6000, preferably 3500 to 5500, a ratio (Mw/Mn) of a weight-mean molecular weight (Mw) to number-mean molecular weight of 2 to 6, preferably 2.5 to 5.5, a glass transition point of 50 to 70° C., preferably 55 to 65° C., and a softening point of 90 to 110° C., preferably 90 to 105° C.

If the number-mean molecular weight is less than 3000, the image portion is peeled off to cause an image defect (deterioration of bend fixability) when a full-color solid image is bent. If the number-mean molecular weight is more than 6000, the heat meltability during the process of fixation is lowered, resulting in a fixing strength decrease. If Mw/Mn is smaller than 2, a high-temperature offset is likely to occur. If Mw/Mn is larger than 6, the sharp melt performance in the process of fixation is lowered, so that the light-transmittance of toner and the color mixing performance in the process of color image formation are lowered. If the glass transition point is lower than 50° C., the heat resistance of the toner is insufficient, and this tends to cause toner aggregation during storage. If the glass transition point is higher than 75° C., the fixing performance is lowered and the color mixability of the toner during the process of color image formation is also lowered. If the softening point is lower than 90° C., a high temperature offset is likely to occur. If the softening point is higher than 110° C., there would occur degradation in fixing strength, light-transmittance, color mixability, and also in full-color image glossiness.

Colorants usable for the toner of the present invention are not particularly limited, and any known colorants may be used as such. Preferably, colorants to be used in color toners are previously subjected to master batch treatment or flushing for enhancing the dispersibility of the colorants. The colorant content of the toner is preferably 2 to 15 parts by weight relative to 100 parts by weight of the binder resin.

For the charge control agent, any known charge control agents may be used. For the negative charge control agent to be used in color toners, any achromatic, white, or monochromatic charge control agent may be usable which does not adversely affect tone, and light-transmittance of the color toner. It is desirable to use charge control agents including, for example, salicylic metal complex, such as zinc complex of salicylic acid derivative, calix arene compounds, organic boron compounds, and fluorine-containing quaternary ammonium base compounds. For the salicylic metal complex, those described in, for example, Japanese Patent Application Laid-Open Nos. 53-127726 and 62-145255 can be used as such. For the calix arene compound, the one described in, for example, Japanese Patent Application Laid-Open No. 2-201378 can be used as such. For the organic boron compound, the one described in, for example, Japanese Patent Application Laid-Open No. 2-221967 can be used as such. For the fluorine-containing quaternary ammonium base compound, the one described in, for example, Japanese Patent Application Laid-Open No. 3-1162 can be used as such. In case that such charge control agent is used as an additive, it is desirable that the quantity of the agent so added is 0.1 to 10 parts by weight, preferably 0.5 to 5.0 parts by weight, relative to 100 parts by weight of the binder resin.

In the present invention, for preparation of the second toner particles the method to be employed is not particularly limited, and any known method for toner particle preparation may be employed as such. However, it is undesirable to employ a crushing method because pulverization to finer particle size results in an increase in the proportion of fine particles, and because the pulverization also results in the formation of indefinite particle configuration which in turn requires the particles to be made spherical. Therefore, for preparation of the toner according to the second aspect of the invention, toner particles granulated in a wet system, such as an aqueous medium, are preferably used. Examples of toner particles granulated in a wet system include toner particles produced by a method wherein toner compositions containing a polymerizable monomer are suspended for granulation in an aqueous medium and the polymerizable monomers in the resulting particles are polymerized (first preparation method); and toner particles produced by a method wherein toner compositions containing a binder resin and a hydrophobic organic solvent capable of dissolving the binder resin are suspended for granulation and then the organic solvent is removed from the resulting particles (second preparation method). In such a method for preparation of toner particles in a wet system, toner compositions comprising a core and a covering layer material may be used to give capsule toner particles.

Usable as polymerizable monomers in the first preparation method are vinyl monomers including, for example, styrenes and derivatives thereof, such as styrene, o-methylstyrene, m-methylstyrene, p-methylstyrene, α-methylstyrene, p-ethylstyrene, 2,4-dimethylstyrene, p-tert-butylstyrene, and p-chlorostyrene; ethylenic unsaturated monoolefins, such as ethylene, propylene, butylene, and isobutylene; methacrylic alkyl esters, such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl)butyl methacrylate, hexyl methacrylate, octyl methacrylate, nonyl methacrylate, decyl methacrylate, undecyl methacrylate, and dodecyl methacrylate; acrylic alkyl esters, such as methyl acrylate, n-propyl acrylate, isopropyl acrylate, n-butyl acrylate, isobutyl acrylate, t-butyl acrylate, n-pentyl acrylate, iso-pentyl acrylate, neopentyl acrylate, 3-(methyl) butyl acrylate, hexyl acrylate, octyl acrylate, nonyl acrylate, decyl acrylate, undecyl acrylate, and dodecyl acrylate; unsaturated carboxylic acids, such as acrylic acid, methacrylic acid, itaconic acid, and maleic acid; and acrylonitrile, maleate, itaconate, vinyl chloride, vinyl acetate, vinyl benzoate, vinylmethyl ethyl ketone, vinyl hexyl ketone, vinyl methyl ether, vinyl ethyl ether, and vinyl isobutyl ether.

For polymerization initiation, oil-soluble polymerization initiators may be used including, for example, azoic polymerization initiators, such as 2,2'-azobis(2,4-dimethyl valeronitrile), 2,2'-azobis-isobutylonitrile, 1,1'-azobis (cyclohexane-1-carbonitrile), and 2,2'-azobis-4-methoxy-2, 4-dimethyl valeronitrile; and peroxide polymerization initiators, such as benzoyl peroxide, methyl ethyl ketone peroxide, isopropyl peroxycarbonate, and lauroyl peroxide.

A dispersion stabilizer may be added for stabilizing particles suspended in the aqueous medium. Examples of such a stabilizer include water-soluble polymers, such as polyvinyl alcohol, gelatin, tragacanth gum, starch, methyl cellulose, hydroxyethyl cellulose, and sodium polyacrylate; surface active agents, such as sodium dodecylbenzene sulfonate, sodium tetradecyl sulfate, sodium pentadecyl sulfate, sodium octyl sulfate, sodium oleate, sodium laurate, and calcium oleate; and alginate, casein, barium sulfate, calcium sulfate, barium carbonate, magnesium carbonate, calcium phosphate, talc, titanium hydroxide, and metal oxide.

For the binder resin in the second method for toner preparation, known binder resins may be used including, for example, styrenic resins, acrylic resins, such as alkyl acrylate and alkyl methacrylate, styrene-acrylic copolymer resins, polyester resins, epoxy resins, silicon resins, olefin resins, and amide resins. These resins may be used singly or in combination of two or more. Any of aforesaid dispersion stabilizers may also be used.

Such second toner particles, as is the case with the first toner particles, may contain any desired additives, such as charge control agent and wax, in addition to the binder resin and colorants.

The toner of the present invention is usable as a two-component developing toner which is to be used in mixture with a carrier, and also as a mono-component developing toner which is to be used without carrier.

For the carrier to be used in combination with the toner of the present invention, any conventional carrier known as a carrier for two-component development may be used. For example, a carrier comprised of magnetic particles, such as iron or ferrite, a resin-coated carrier comprising magnetic particles coated with resin, and a binder carrier comprising magnetic fine powder dispersed in a binder resin may be used as such. Of these carriers, the resin-coated carrier in which a silicone resin, a copolymer resin (graft resin) of organo-polysiloxane with vinyl monomer, or polyester resin are applied can be advantageously used from the standpoint of toner spent. In particular, a carrier covered with a resin obtained by causing isocyanate to react with a copolymer resin of organo-polysiloxane/vinyl monomer is preferred from the view points of durability, environmental stability, and spent-resistance. For the vinyl monomer, it is required that the monomer should have a substituent group, such as hydroxyl group, which is reactive to isocyanate. In order to ensure high image quality and prevent carrier fogging, it is desirable that the carrier should have a volume-mean particle size of 20 to 100 $\mu$m, preferably 20 to 60 $\mu$m.

The present invention will be further elucidated herein below with the reference to a number of examples. It is of course not the intension hereby to limit to the invention.

Examples With Respect To The First Invention

Production of Polyester Resin

A two-liter four-necked flask with a reflux condenser, a water-separator, a nitrogen gas inlet, a thermometer and a stirrer was set in mantle heater. Polyoxypropylene(2,2)-2,2-bis(4-hydoxyphenyl) propane(PO), polyoxyethylene(2,0)-2,2-bis(4-hydroxyphenyl)propane(EO), fumaric acid(FA) and terephthalic acid(TPA) were put into the flask, so that a molar ratio was 5:5:5:4. Nitrogen gas was introduced into the flask and the ingredients were stirred and heated. Polyester resin with a number mean molecular weight (Mn) of 4800, a weight mean molecular weight(Mw) of 4800, a Mw/Mn ratio of 4.0, glass transition point of 58° C. and softening point of 100° C. was given.

Number mean molecular weight and weight mean molecular weight were measured by means of gel permeation chromatography (807-IT; made by Nippon Bunko Kogyo K.K.). A column was kept at 40° C. Tetrahydrofuran was flowed as a carier at 1 kg/cm$^3$. The sample of 30 mg to be measured was dissolved in tetrahydrofuran of 20 ml. The resultant solution of 0.5 mg was introduced with the carrier solvent. Mean morecular weight was on the basis of conversion to polystyrene.

Glass transition point was measured by means of differential scanning calorimeter(DSC-200; made by Seiko Densi K.K.). Sample of 10 mg was used. Alumina was used as reference. Temperature was raised at a ratio of 10° C./min. A shoulder of main absorption peak was read as glass transition point.

Softening point was measured by means of flow-tester (CFT-500; Simazu Seisakusyo K.K.). Sample of 1.0 g and a dice with pore diameter of 1.0 mm and pore length of 1.0 mm were used. Measurement was carrieid out under conditions of heating ratio of 3° C./min, preheat time of 180 seconds, loading of 30 Kg, and measuring temperature range of 60–140° C. A temperature at which half of the sample flowed out was read as a softening point.

Production of Toner Particles

The polyester resin and magenta pigment (C.I. pigment red 184) was put in pressure-kneader at a ratio of 7:3 (resin:pigment) and keaded. The resultant kneaded material was cooled and pulverized in a feather mill to give pigment master batch.

The polyester resin of 93 parts by weight, the pigment master batch of 10 parts by weight and a charge control agent (zinc complex of salicylic acid: E-84; Orient Kagaku Kogyo K.K) of 2 parts by weight were mixed in a Henschel mixer. The resultant mixture was kneaded in a two-axial extruding kneader. The resultant kneaded material was cooled, pulverized roughly in a feather mill, pulverized moderately in mechanical pulverizer (IDS-5; Criptron KTMO; made by Kawasaki Ju-Kogyo K.K.), pulverized finely in a jet mill (IDS-5; made by Nippon Pneumatic K.K.) and further classified by Teeplex classifier (Type 100; made by Hosokawa Micron K.K.). Toner particles 1 to 14 having a respective particle size shown in Table 1 were shown.

TABLE 1

| | $D_{50}$ | $D_{75}$ | $D_{25}$ | $D_{25}/D_{75}$ | 1.75–0.05 $D_{50}$ | 1.45–0.05 $D_{50}$ |
|---|---|---|---|---|---|---|
| Toner particles 1 | 3.1 | 2.4 | 3.8 | 1.58 | 1.595 | 1.295 |
| Toner particles 2 | 3.2 | 2.3 | 3.9 | 1.70 | 1.590 | 1.290 |
| Toner particles 3 | 3.2 | 2.8 | 3.5 | 1.25 | 1.590 | 1.290 |
| Toner particles 4 | 3.1 | 2.5 | 3.7 | 1.48 | 1.595 | 1.295 |
| Toner particles 5 | 3.2 | 2.7 | 3.6 | 1.33 | 1.590 | 1.290 |
| Toner particles 6 | 5.1 | 4.2 | 5.6 | 1.33 | 1.495 | 1.195 |
| Toner particles 7 | 4.8 | 3.7 | 6.1 | 1.65 | 1.510 | 1.210 |
| Toner particles 8 | 4.9 | 4.5 | 5.3 | 1.18 | 1.505 | 1.205 |
| Toner particles 9 | 5.1 | 4.2 | 6.1 | 1.45 | 1.495 | 1.195 |
| Toner particles 10 | 5.2 | 4.6 | 5.6 | 1.22 | 1.490 | 1.190 |
| Toner particles 11 | 6.8 | 5.8 | 7.5 | 1.29 | 1.410 | 1.110 |
| Toner particles 12 | 6.8 | 5.2 | 8.0 | 1.54 | 1.410 | 1.110 |
| Toner particles 13 | 6.8 | 5.9 | 8.1 | 1.37 | 1.410 | 1.110 |
| Toner particles 14 | 6.9 | 6.5 | 7.4 | 1.14 | 1.405 | 1.105 |

Toner particles 3 and 8 have a narrow particle size distribution as classification was repeated to adjust particle size distribution. As a result, the direct yield was so low that those particles are unsuitable for commercialization.

Production Example of Carrier

Methyl ethyl ketone of 100 parts by weight was put into a 500-ml flask with a reflux condenser, a water-separator, a nitrogen gas inlet, a thermometer and a stirrer. Separately, methyl ethyl ketone of 36.7 parts by weight, 2-hydroxyethyl methacrylate of 5.1 parts by weight, 3-methacryloxypropyltris (trimethylsiloxy) silane of 58.2 parts by weight and 1,1'-azobis(cyclohexane-1-carbonitrile) of 1 part by weight were dissolved in methyl ethyl keton at 80° C. under nitrogen atmosphere. The resultant solution was dropped into the reaction flask for 2 hours and aged for 5 hours.

Isophorone diisocyanete/trimethylolpropane adduct (NCO%=6.1%) was prepared as a crosslinking agent. The above obtained resin was mixed with the crosslinking agent so that a molar ration of OH/NCO could be 1/1. The resultant mixture was diluted with methyl ethyl ketone to give a coating resin solution having a solid content of 3% by weight.

Sintered ferrite powder F-300 (volume mean particle size:50 $\mu$m; made by Powdertech K.K.) was used a core material. The core material was coated with the coating solution by Spira Cota (made by Okada Seiko K.K.) and dried, so that a coated resin amount could be 1.5% by weight relative to the core material.

The obtained carrier was left to be sintered in an oven with internal air circulation at 160° C. for 1 hour. After cooling, ferrite particle bulk was pulverized by means of shaking screen classifier provided with screen mesh having openings of 106 μm and 75 μm to give resin-coated carrier.

EXAMPLE 1

The toner particles 6 were mixed with hydrophobic titania particles (in which anatase titania particles having a primary mean particle size of 30 nm were treated with a n-butyltrimethoxysilane to give hydrophobicity of 60) of 1.5% by weight and strontium titanate particles (number mean particle size of 500 nm with a 10 number % content of particles having a particle size of 1000 nm or more) of 1.5% by weight were mixed in Henschel mixer to give toner 1.

EXAMPLE 2

Toner 2 was prepared in a manner similar to Example 1, except that strontium titanate particles having a number mean particle size of 200 nm with a 0 number % content of particles having a particle size of 1000 nm or more were used.

EXAMPLE 3

Toner 3 was prepared in a manner similar to Example 1, except that rutile titania particles (a number mean particle size of 400 nm with a 5 number % content of particles having a particle size of 1000 nm or more used instead of strontium titanate particles.

EXAMPLE 4

Toner 4 was prepared in a manner similar to Example 1, except that silica particles (a number mean particle size of 500 nm with a 10 number % content of particles having a particle size of 1000 nm or more were used instead of strontium titanate particles.

EXAMPLE 5

Toner 5 was prepared in a manner similar to Example 1, except for use of hydrophobic titania particles in which anatase titania particles having a primary mean particle size of 15 nm was treated with n-butyltrimethoxysilane to give hydrophobicity of 60.

EXAMPLE 6

Toner 6 was prepared in a manner similar to Example 1, except for use of hydrophobic silica particles in which silica particles having a primary mean particle size of 20 nm were treated with hexamethyldisilazane to give hydrophobicity of 60 instead of use of hydrophobic titania particles.

EXAMPLE 7

Toner 7 was prepared in a manner similar to Example 1, except for use of toner particles 1.

EXAMPLE 8

Toner 8 was prepared in a manner similar to Example 1, except for use of toner particles 11.

EXAMPLE 9

Toner 9 was prepared in a manner similar to Example 1, except for addition amount of hydrophobic titania particles of 0.7% by weight and for use of hydrophobic titania of 0.8% by weight in which anatase titania particles having a primary mean particle size of 50 nm was treated with n-butyltrimethoxysilane to give hydrophobicity of 60.

Comparative Example 1

Toner 10 was prepared in a manner similar to Example 1, except that hydrophobic titania particles were added at an amount of 0.5% by weight and that no strontium titanate was added.

Comparative Example 2

Toner 11 was prepared in a manner similar to Comparative Example 1, except that hydrophobic titania particles were added at an amount of 1.5% by weight.

Comparative Example 3

Toner 12 was prepared in a manner similar to Example 1, except for use of strontium titanate particles having a number mean particle size of 1000 nm with a 50 number % content of particles having a particle size of 1000 nm or more.

Comparative Example 4

Toner 13 was prepared in a manner similar to Example 1, except that toner particles 2 were used.

Comparative Example 5

Toner 14 was prepared in a manner similar to Example 1, except that toner particles 17 were used.

Toner 15 was prepared in a manner similar to Example 1, except that toner particles 12 were used.

Preparation of Developer

Toners 1–15 were mixed with the carrier prepared in the above Production Example of Carrier so that toner ratio could be 5% by weight to give developers. These developers were respectively provided for a digital full-color copying machine CF900 (made by Minolta K.K.) to reproduce images with B/W ratio of 15%, 5000 times under N/N circumstances (25° C., 50%). The evaluation was made as follows:

Aggregation (voids)

Respective developer was subjected to 5000 times of copy of images with B/W ratio of 15% under N/N circumstances. After copying, solid images (ID=1.2) were reproduced on whole surface of three sheets of A3 paper to make evaluation on the basis of average value of three sheets of paper. The evaluation was ranked as;

"X" when image defects (voids) having a size of 2 $mm^2$ or more and a half or less of ID of the solid image could be seen.

"Δ" when the above voids could not be seen, but three or more aggregation cores of about 0.3 μm appeared and image density around the cores are a little lowered, "○" when less than 3 such cores as above mentioned were seen, and "◎" when no such core as above mentioned was seen.

Evaluation of Chargeability (voids)

Chargeability was evaluated to be ranked as;

"○" when fogging could not be seen in copied images on white ground at initial stage of copying step with respect to durability test, "Δ" when a little fogging was seen in copied images on white ground at initial stage of copying step with respect to durability test, but there is no problem on practical use, and "X" when fogging was seen remarkably in copied images on white ground at initial stage of copying step with respect to durability test.

Gradation (Half Tone, Texture of Images)

Tone pattern having 0–256 gradations was prepared. The copied images thereof were measured to be ranked as;

"○" when uniform copied images were reproduced without rough touch from highlight portion to solid portion, "Δ" when rough touch was felt at highlight portion, but there is no practical problem, and "X" when rough touch or irregularity was felt from middle density portion to highlight portion.

Toner Fixing on Photosensitive Member (BS)

After durability test with respect to copy, the surface of photosensitive member was observed visually and by electron microscope, and solid images were observed. The evaluation was ranked as;

"◎" when fixing of externally added materials was not observed on the surface of photosensitive member by electron microscope, "○" when fixing of externally added materials was observed on the surface of photosensitive member by electron microscope, but fixing of externally added materials was not observed visually and image noises were not observed, "Δ" when fixing of externally added materials and toner components was observed visually on the surface of photosensitive member and image noises were not observed, and "X" when fixing of externally added materials and toner components was observed visually on the surface of photosensitive member and the fixing materials were recognized as images noises.

Injuries on Photosensitive Member

The surface of photosensitive member was observed visually after durability test with respect to copy. The evaluation was ranked as;

"○" when no injuries were observed on the surface of photosensitive member,

"Δ" when the surface of photosensitive member looked thinly clouded, and

"X" when scratches were observed on the surface of photosensitive member.

TABLE 2

| | Toner | Aggregation | Fogging | Gradation | Cleaning properties BS | Cleaning properties PS*injury |
|---|---|---|---|---|---|---|
| Example 1 | 1 | ○ | ○ | ○ | ◎ | ○ |
| Example 2 | 2 | ○ | ○ | ○ | ○ | ○ |
| Example 3 | 3 | ○ | Δ | ○ | ○ | ○ |
| Example 4 | 4 | ○ | ○ | ○ | ◎ | ○ |
| Example 5 | 5 | ○ | ○ | ○ | ◎ | ○ |
| Example 6 | 6 | ○ | ○ | ○ | ◎ | ○ |
| Example 7 | 7 | Δ | ○ | ○ | ◎ | ○ |
| Example 8 | 8 | ◎ | ○ | ○ | ◎ | ○ |
| Example 9 | 9 | ○ | ○ | ○ | ◎ | ○ |
| Com.Exam.**1 | 10 | X | ○ | X | ○ | ○ |
| Com.Exam.2 | 11 | ○ | ○ | ○ | X | ○ |
| Com.Exam.3 | 12 | ○ | ○ | ○ | Δ | X |
| Com.Exam.4 | 13 | X | X | Δ | ◎ | ○ |
| Com.Exam.5 | 14 | X | X | Δ | ◎ | ○ |
| Com.Exam.6 | 15 | X | Δ | X | ◎ | ○ |

*PS: photosensitive member

**Com.Exam.: Comparative Example

Two kinds of toners were obtained in a manner similar to Example 1, except that toner particles 9 and toner particles 10 were used. Each toner was evaluated in a manner similar to Example 1 to give the same results as Example 1.

Two kinds of toners were obtained in a manner similar to Example 7, except that toner particles 4 and toner particles 5 were used. Each toner was evaluated in a manner similar to Example 7 to give the same results as Example 7.

Two kinds of tones were obtained in a manner similar to Example 8, except that toner particles 13 and toner particles 14 were used. Each toner was evaluated in a manner similar to Example 8 to give the same results as Example 8.

As clearly understood from the above, the first invention can provide an electrostatic latent image-developing toner which is excellent in fluidity, and has no problem on toner adherence to photosensitive member even after repetition of copy.

The first invention can also provide an electrostatic latent image-developing toner which does not cause voids in solid copied images even after repetition of copy.

The first invention can also provide an electrostatic latent image-developing toner suitable for full-color image-formation.

Examples With Respect To The second Invention

Production of Toner Particles 15

Styrene of 170 parts by weight, n-butyl acrylate of 30 parts by weight, cyan pigment (C.I.pigment blue 15:3) of 10 parts by weight, styrene-mathacrylic acid-methyl methacrylate copolymer (85:5:10, weight-mean molecular weight of 58,000) of 5 parts by weight, paraffin wax (melting point of 70° C.) of 40 parts by weight, charge control agent (salicylic chromium complex; E-81:Orient Kagaku Kogyo K.K.) of 5 parts by weight, 2,2'-azobis(2,4-dimethyl valeronitrile) of 10 parts by weight were mixed to give a polymerizable composition. The polymerizable composition was added to 1,200 parts by weight of an aqueous medium with calcium phosphate dispersed at 4% by weight. The resultant solution was stirred for 15 minutes by T.K.Auto Homo Mixer(made by Tokusyu Kika Kogyo K.K.) to disperse fine particles of the polymerizable composition so that the particle size could be about 5 μm in the aqueous medium. The resultant dispersion was stirred under nitrogen atmosphere as temperature was raised up to 80° C. The dispersion was subjected to reaction for 10 hours. After cooling, calcium phosphate was dissolved with hydrochloric acid. The resultant solution was subjected to filtration and water-washing repeatedly. Then the obtained particles were dried, and air-classified to give toner particles 15 having a volume-mean particle size of 4.9 μm. The toner particles 15 had shape factor SF1 of 107.

Production of Toner Particles 16

Styrene of 165 parts by weight, n-butyl acrylate of 35 parts by weight, cyan pigment (C.I.pigment blue 15:3) of 13 parts by weight, polyester resin (synthesized with bisphenol A propylene oxide adduct/terephthalic acid; weight-mean molecular weight of 7,000, acid value of 13 KOHmg/g) of 9 parts by weight, paraffin wax (melting point of 70° C.) of 60 parts by weight, charge control agent (salicylic chromium complex; E-81:Orient Kagaku Kogyo K.K.) of 2 parts by weight, 2,2'-azobis(2,4-dimethyl valeronitrile) of 10 parts by weight were mixed to give a polymerizable composition. The polymerizable composition was added to 1,200 parts by weight of an aqueous medium with calcium phosphate dispersed at 4% by weight. The resultant solution was stirred for 15 minutes by T.K.Auto Homo Mixer(made by Tokusyu Kika Kogyo K.K.) to disperse fine particles of the polymerizable composition so that the particle size could be about 5 μm in the aqueous medium. The resultant dispersion was stirred under nitrogen atmosphere as temperature was raised up to 80° C. The dispersion was subjected to reaction for 10 hours. After cooling, calcium phosphate was dissolved with hydrochloric acid. The resultant solution was subjected to filtration and water-washing repeatedly. Then the obtained particles were dried, and air-classified to give toner particles 16 having a volume-mean particle size of 6.1 μm. The toner particles 16 had shape factor SF1 of 105.

Production of Toner Particles 17

Styrene of 165 parts by weight, n-butyl acrylate of 35 parts by weight, cyan pigment (C.I.pigment blue 15:3) of 13 parts by weight, polyester resin (synthesized with bisphenol A propylene oxide adduct/terephthalic acid; weight-mean molecular weight of 7,000, acid value of 13 KOHmg/g) of 9 parts by weight, paraffin wax (melting point of 70° C.) of 60 parts by weight, charge control agent (salicylic chromium complex; E-81:Orient Kagaku Kogyo K.K.) of 2 parts by weight, 2,2'-azobis(2,4-dimethyl valeronitrile) of 10 parts by weight were mixed to give a polymerizable composition. The polymerizable composition was added to 1,200 parts by weight of an aqueous medium with calcium phosphate dispersed at 4% by weight. The resultant solution was stirred for 15 minutes by T.K.Auto Homo Mixer(made by Tokusyu Kika Kogyo K.K.) to disperse fine particles of the polymerizable composition so that the particle size could be about 6 μm in the aqueous medium. The resultant dispersion was stirred under nitrogen atmosphere as temperature was raised up to 80° C. The dispersion was subjected to reaction for 10 hours. The obtained slurry was put into a dispersing machine of wet medium-type containing glass beads of 1 mm diameter at the same volume as the slurry. The treatment was carried out for 1 minute. After cooling, the glass beads were removed trough a 350 μm mesh. Then calcium phosphate was dissolved with hydrochloric acid. The resultant solution was subjected to filtration and water-washing repeatedly. Then the obtained particles were dried, and air-classified to give toner particles 17 having a volume-mean particle size of 5.8 μm. The toner particles 17 had shape factor SF1 of 125.

Production of Toner Particles 18

Polyester resin having a softening point of 100° C., a glass transition point of 58° C., and an acid value of 3.5 KOHmg/g was synthesized with bisphenol A propylene oxide adduct/bisphenol A ethylene oxide adduct/fumaric acid/terephthalic acid. A solution of the obtained polyester of 100 parts by weight dissolved in toluene of 400 parts by weight, cyan pigment (C.I.pigment blue 15:3) of 6 parts by weight, and charge control agent (salicylic zinc complex; E-84:Orient Kagaku Kogyo K.K.) of 2 parts by weight were put into a ball mill to be dispersed for 3 hours. A colored resin solution was given. The resultant colored resin solution of 100 parts by weight was stirred in T.K.Auto Homo Mixer(made by Tokusyu Kika Kogyo K.K.). Calcium phosphate was dispersed in the resin solution at 3.5% by weight. An aqueous medium with sodium lauryl sulfate dissolved at 0.1% by weight was added gradually to the resin solution. When about 150 parts by weight of the aqueous solution was added, phase transition occurred. At this time, the addition of the aqueous solution was stopped. Stirring was continued for further 10 minutes. After stirring, toluene was removed at 65° C. under a pressure of 80 mmHg. Calcium phosphate was dissolved with hydrochloric acid. The resultant solution was subjected to filtration and water-washing repeatedly. Then the obtained particles were dried, and air-classified to give toner particles 18 having a volume-mean particle size of 5.1 μm. The toner particles 18 had shape factor SF1 of 112.

Production of Toner Particles 19

Styrene-acrylic coplymer (synthesized with styrene/n-butyl acrylate; softening point of 75.3° C., glass transition point of 40.5° C.) of 100 parts by weight, cyan pigment (C.I.pigment blue 15:3) of 6 parts by weight, polyester resin (synthesized with bisphenol A propylene oxide adduct/terephthalic acid/dodecenylsuccinic anhydride; softening point of 110° C., glass transition point of 63° C., acid value of 10 KOHmg/g) of 15 parts by weight,and polypropylene wax (Biscol 550P; made by Sanyo Kasei K.K) of 5 parts by weight were mixed. The resultant mixture was kneaded by a two-axial extruding kneader. The kneaded material was cooled and pulverized. The pulverized material of 40 parts by weight, styrene of 50 parts by weight, n-butyl acrylate of 15 parts by weight, 2,2'-azobisisobutyronitrile) of 2.5 parts by weight were mixed to give a polymerizable composition. The polymerizable composition of 240 parts by weight and 560 parts by weight of an aqueous medium with calcium phosphate dispersed at 4% by weight were stirred at 5° C. for 2 minutes in T.K.Auto Homo Mixer(made by Tokusyu Kika Kogyo K.K.). The resultant mixture was stirred under nitrogen atmosphere as temperature was raised up to 85° C. The mixture was subjected to reaction for 10 hours. After cooling, calcium phosphate was dissolved with hydrochloric acid. The resultant solution was subjected to filtration and water-washing repeatedly. Then the obtained particles were dried, and air-classified to give toner particles 19 having a volume-mean particle size of 4.8 μm, the outer surface of the toner was formed of polyester The toner particles 19 had shape factor SF1 of 112.

Production of Toner Particles 20–22

The polyester resin obtained in production of toner particles 18 and magenta pigment (C.I. pigment blue) was put in pressure-kneader at a ratio of 7:3 (resin:pigment) and keaded. The resultant kneaded material was cooled and pulverized in a feather mill to give pigment master batch. The above polyester resin of 93 parts by weight, the above pigment master batch of 10 parts by weight and a charge control agent (zinc complex of salicylic acid: E-84; Orient Kagaku Kogyo K.K) of 2 parts by weight were mixed in a Henschel mixer. The resultant mixture was kneaded in a two-axial extruding kneader. The resultant kneaded material was cooled, pulverized roughly in a feather mill, and pulverized finely in a jet mill and further classified by air classifier under specified pulverizing and classifying conditions to give toner particles 20 having a volume-mean particle size of 3.1 μm and a shape factor SF1 of 157, toner particles 21 having a volume-mean particle size of 5.3 μm and a shape factor SF1 of 161 and toner particles 22 having a volume-mean particle size of 7.4 μm and a shape factor SF1 of 168.

EXAMPLE 10

The toner particles 15 were mixed with hydrophobic titania particles (in which anatase titania particles having a primary mean particle size of 30 nm were treated with n-butyltrimethoxysilane to give hydrophobicity of 60) of 1.5% by weight and strontium titanate particles (number mean particle size of 500 nm with a 10 number % content of particles having a particle size of 1000 nm or more) of 1.5% by weight were mixed in Henschel mixer to give toner 16.

EXAMPLE 11

Toner 17 was prepared in a manner similar to Example 10, except that strontium titanate particles having a number mean particle size of 200 nm with a 0 number % content of particles having a particle size of 1000 nm or more were used.

EXAMPLE 12

Toner 18 was prepared in a manner similar to Example 10, except that rutile titania particles (a number mean particle size of 400 nm with a 5 number % content of particles having a particle size of 1000 nm or more were used instead of strontium titanate particles.

EXAMPLE 13

Toner 19 was prepared in a manner similar to Example 10, except that silica particles(a number mean particle size of 500 nm with a 10 number % content of particles having a particle size of 1000 nm or more were used instead of strontium titanate particles.

EXAMPLE 14

Toner 20 was prepared in a manner similar to Example 1, except for use of hydrophobic titania particles in which anatase titania particles having a primary mean particle size of 15 nm was treated with n-butyltrimethoxysilane to give hydrophobicity of 60.

EXAMPLE 15

Toner 21 was prepared in a manner similar to Example 10, except for use of hydrophobic silica particles in which silica particles having a primary mean particle size of 20 nm were treated with hexamethyldisilazane to give hydrophobicity of 60 instead of use of hydrophobic titania particles.

EXAMPLE 16

Toner 22 was prepared in a manner similar to Example 10, except for addition amount of hydrophobic titania particles of 0.7% by weight and for use of hydrophobic titania of 0.8% by weight in which anatase titania particles having a primary mean particle size of 50 nm was treated with n-butyltrimethoxysilane to give hydrophobicity of 60.

EXAMPLE 17

Toner 23 was prepared in a manner similar to Example 10, except for use of toner particles 16.

EXAMPLE 18

Toner 24 was prepared in a manner similar to Example 10, except for use of toner particles 17.

EXAMPLE 19

Toner 25 was prepared in a manner similar to Example 10, except for use of toner particles 18.

EXAMPLE 20

Toner 26 was prepared in a manner similar to Example 10, except for use of toner particles 19.

Comparative Example 7

Toner 27 was prepared in a manner similar to Example 10, except that hydrophobic titania particles were added at an amount of 0.5% by weight and that no strontium titanate was added.

Comparative Example 8

Toner 28 was prepared in a manner similar to Comparative Example 7, except that hydrophobic titania particles were added at an amount of 1.5% by weight.

Comparative Example 9

Toner 29 was prepared in a manner similar to Example 10, except for use of strontium titanate particles having a number mean particle size of 1000 nm with a 50 number % content of particles having a particle size of 1000 nm or more.

Comparative Example 10

Toner 30 was prepared in a manner similar to Example 10, except that toner particles 20 were used.

Comparative Example 11

Toner 31 was prepared in a manner similar to Example 10, except that toner particles 14 were used.

Comparative Example 12

Toner 32 was prepared in a manner similar to Example 10, except that toner particles 22 were used.

Preparation of Developer

Toners 16–32 were mixed with the carrier prepared in the above Production Example of Carrier so that toner ratio could be 5% by weight to give developers. These developers were respectively provided for a digital full-color copying machine CF900 (made by Minolta K.K.) to reproduce images with B/W ratio of 15%, 5000 times under N/N circumstances (25° C.,50%). The evaluations with respect to aggregation (voids), gradient (half tone, texture of images), cleaning residue, toner fixing on photosensitive member (BS), injuries on photosensitive member and transfer properties were made. The evaluations with respect to aggregation (voids), gradient (half tone, texture of images), toner fixing on photosensitive member (BS) and injuries on photosensitive member were made in the same way as above mentioned. The evaluations with respect to cleaning residue and transfer properties were made as follows.

Cleaning Residue

The evaluation of cleaning residue was made to be ranked as;

"○" when adherence of toner particles which passed through cleaning blade could be observed visually on photosensitive member after durability test with respect to copy, "Δ" when adherence of a little toner particles could be observed but no copy noise could be observed in copied images, and "X" when adherence of toner particles could be observed and copy noises could be observed in copied images.

Transfer Properties

Patch pattern was developed on photosensitive member on a digital copying machine (Di30; made by Minolta K.K.). Immediately after the developed patch pattern was transferred on transfer paper, the transfer paper was pulled out. Transfer properties means a ratio of adherence amount of toner on transfer paper to adherence amount of toner on photosensitive member.

The transfer properties were ranked as;

"◎" when transfer efficiency was 95% or more,

"○" when transfer efficiency was between 90% or more and less than 95%,

"Δ" when transfer efficiency was between 85% or more and less than 90%, and

"X" when transfer efficiency was less than 85%.

The results are shown in Table 3.

TABLE 3

| | Toner | Aggre-gation | Tran. Pros[1)] | Grada-ion | Cleaning properties: Resi-due[2)] | BS | PS[3)] Injury |
|---|---|---|---|---|---|---|---|
| Example 10 | 16 | ○ | ○ | ○ | ○ | ◎ | ○ |
| Example 11 | 17 | ○ | ○ | ○ | ○ | ○ | ○ |
| Example 12 | 18 | ○ | ○ | ○ | ○ | ○ | ○ |
| Example 13 | 19 | ○ | ○ | ○ | ○ | ◎ | ○ |
| Example 14 | 20 | ○ | ○ | ○ | ○ | ◎ | ○ |
| Example 15 | 21 | ○ | ○ | ○ | ○ | ◎ | ○ |
| Example 16 | 22 | ○ | ○ | ○ | ○ | ◎ | ○ |
| Example 17 | 23 | ◎ | ◎ | ○ | ○ | ◎ | ○ |
| Example 18 | 24 | ○ | Δ | ○ | ○ | ◎ | ○ |
| Example 19 | 25 | ○ | ○ | ○ | ○ | ◎ | ○ |
| Example 20 | 26 | ○ | ○ | ○ | ○ | ◎ | ○ |
| Com.Exam.[4)]7 | 27 | X | X | X | X | ○ | ○ |
| Com.Exam.8 | 28 | ○ | Δ | ○ | X | X | ○ |
| Com.Exam.9 | 29 | ○ | ○ | ○ | Δ | Δ | X |
| Com.Exam.10 | 30 | X | X | ○ | ○ | ◎ | ○ |
| Com.Exam.11 | 31 | Δ | X | ○ | ○ | ◎ | ○ |
| Com.Exam.12 | 32 | ○ | Δ | Δ | ○ | ◎ | ○ |

[1)]Trans.Pros.: transfer properties,
[2)]residue: residue of toener
[3)]PS: photosensitive member
[4)]Com.Exam.: Comparative Example As clearly understood from the above, the second invention can provide an electrostatic latent image-developing toner which is excellent in image quality and transfer properties.

The second invention can also provide an electrostatic latent image-developing toner which is excellent in fluidity and can solve problems on poor cleaning properties of small spherical toner particles and toner adherence to photosensitive member The second invention can also provide an electrostatic latent image-developing toner suitable for full-color image-formation.

What is claimed is:

1. An electrostatic latent image-developing toner which comprises:

toner particles containing a colorant and a binder resin, the toner particles satisfying the following relation:

$$1.45-0.05\ D_{50} \leqq D_{25}/D_{75} \leqq 1.75-0.05D_{50} \quad (1)$$

in which, $D_{25}$, $D_{50}$ and $D_{75}$ denote toner particle sizes such that when the toner particles are integrated from the larger particle side, the volume percentages of toner particles of respective particle sizes are 25%, 50%, and 75% based on the total volume of the toner particles, and the particles size $D_{50}$ being within the range of from 3 to 7 μm; and an external additive admixed with the toner particles, the external additive containing hydrophobic inorganic fine particles A having a number-mean particle size of 5 to 70 nm, and inorganic fine particles B having a number-mean particle size of 80 to 800 nm with a 20 number % or less content of particles having a particle size of 1000 nm or more, wherein the inorganic fine particles A are composed of at least one kind of inorganic fine particles selected from the group consisting of silica and titania, and the inorganic fine particles B are composed of strontium titanate.

2. An electrostatic latent image-developing toner as set forth in claim 1, wherein the toner particles are particles prepared through the steps of pulverization and classification.

3. An electrostatic latent image-developing toner as set forth in claim 1, wherein the toner particles satisfy the relation $1.50-0.05\ D_{50} \leqq D_{25}/D_{75} \leqq 1.70-0.05D_{50}$, particle size $D_{50}$being within the range of 4 to 7 μm.

4. An electrostatic latent image-developing toner as set forth in claim 1, wherein the quantity of addition of the inorganic fine particles A is 0.8 to 3% by weight relative to the quantity of the toner particles, and the quantity of addition of the inorganic fine particles B is 0.3 to 5% by weight relative to the quantity of the toner particles.

5. An electrostatic latent image-developing toner as set forth in claim 4, wherein the quantity of addition of the inorganic fine particles A is 1.0 to 2.5% by weight relative to the quantity of the toner particles, and the quantity of addition of the inorganic fine particles B is 0.5 to 3% by weight relative to the quantity of the toner particles.

6. An electrostatic latent image-developing toner as set forth in claim 1, wherein the number-mean particle size of the inorganic fine particles A is 5 to 60 nm and the number-mean particle size of the inorganic fine particles B is 100 to 700 nm, with a 10 number % or less content of particles having a particle size of 1000 nm or more.

7. An electrostatic latent image-developing toner as set forth in claim 6, wherein the number-mean particle size of the inorganic fine particles A is 5 to 40 nm and the number-mean particle size of the inorganic fine particles B is 150 to 600 nm.

8. An electrostatic latent image-developing toner which comprises:

toner particles containing a colorant and a binder resin, the toner particles having a volume-mean particle size of 3 to 7 μm and a shape factor SF1 of 100 to 130 as expressed by the following relation (2):

$$SF1=\{100\pi\times(\text{max length})^2\}/\{4\times(\text{area})\} \quad (2)$$

In which "max length" represents mean value of maximum lengths of projected toner particle images, and "area" represents mean value of projected toner particle areas; and an external additive admixed with the toner particles, the external additive containing hydrophobic inorganic fine particles A having a number-mean particle size of 5 to 70 nm, and inorganic fine particles B having a number-mean particle size of 80 to 800 nm with a 20 number % or less content of particles having a particle size of 1000 nm or more, wherein the inorganic fine particles A are composed of at least one kind of inorganic fine particles selected from the group consisting of silica and titania, and the inorganic fine particles B are composed of strontium titanate.

9. An electrostatic latent image-developing toner as set forth in claim 8, wherein the toner particles are toner particles formed in an aqueous medium.

10. An electrostatic latent image-developing toner as set forth in claim 9, wherein the toner particles are toner particles produced by granulating a toner composition comprising polymerizable monomers in an aqueous medium and polymerizing the polymerizable monomers.

11. An electrostatic latent image-developing toner as set forth in claim 9, wherein the toner particles are toner particles produced by granulating a toner composition comprising a binder resin and an organic solvent compatible therewith in an aqueous medium and removing the organic solvent from the resulting particles.

12. An electrostatic latent image-developing toner as set forth in claim 8, wherein the volume-mean particle size of the toner particles is 4 to 7 $\mu$m and the SF1 of the toner particles is 103 to 125.

13. An electrostatic latent image-developing toner as set forth in claim 8, wherein the quantity of addition of the inorganic fine particles A is 0.8 to 3% by weight relative to the quantity of the toner particles, and the quantity of addition of the inorganic fine particles B is 0.3 to 5% by weight relative to the quantity of the toner particles.

14. An electrostatic latent image-developing toner as set forth in claim 13, wherein the quantity of addition of the inorganic fine particles A is 1.0 to 2.5% by weight relative to the quantity of the toner particles, and the quantity of addition of the inorganic fine particles B is 0.5 to 3% by weight relative to the quantity of the toner particles.

15. An electrostatic latent image-developing toner as set forth in claim 8, wherein the number-mean particle size of the inorganic fine particles A is 5 to 60 nm and the number-mean particle size of the inorganic fine particles B is 100 to 700 nm, with a 10 number % or less content of particles having a particle size of 1000 nm or more.

16. An electrostatic latent image-developing toner as set forth in claim 15, wherein the number-mean particle size of the inorganic fine particles A is 5 to 40 nm and the number-mean particle size of the inorganic fine particles B is 150 to 600 nm.

* * * * *